United States Patent [19]

Lowden

[11] Patent Number: 4,502,788

[45] Date of Patent: Mar. 5, 1985

[54] TIME KEEPING AND RECORDING DEVICE

[76] Inventor: Colin B. Lowden, P.O. Box 1048, Ponoka, Alberta, Canada, T0C 2H0

[21] Appl. No.: 541,148

[22] Filed: Oct. 12, 1983

[51] Int. Cl.[3] ..... G04B 47/00; G04F 8/00; G07C 1/10

[52] U.S. Cl. ..... 368/10; 368/108; 368/110; 346/33 R; 360/69

[58] Field of Search ..... 368/10, 107–113; 346/33 R; 360/6, 13, 69; 179/2 TC, 6.01

[56] References Cited

U.S. PATENT DOCUMENTS 3,959,814 5/1976 Howard ..... 360/13

*Primary Examiner*—Vit W. Miska

*Attorney, Agent, or Firm*—Bernard, Rothwell & Brown

[57] ABSTRACT

A time keeping and recording device is provided, which is particularly suitable for use by lawyers and other professionals to record in an automated fashion the time spent on various activities, together with other information identifying such activities. The preferred embodiment of the invention comprises a stop clock, audio recording means, timer means, and circuit means including switch means, wherein the switch means is operable to reset and start the stop clock, and is operable to stop the stop clock, and wherein either of such operations causes the timer to enable the recorder to operate for a pre-specified time interval, during which a spoken message may be recorded.

17 Claims, 6 Drawing Figures

TIME KEEPING AND RECORDING DEVICE

FIELD OF THE INVENTION

This invention relates to automated time control equipment in general, and in particular, to apparatus for recording elapsed time and other information on magnetic tape.

BACKGROUND OF THE INVENTION

Most lawyers and other professionals who keep time records do so by generating hand-written paper records. Various types of time recording systems are commercially available, some of which utilize time slips and master sheets, in which information is entered only once, with a view to reducing the effort involved in keeping such time records. However, known commercially available systems utilizing paper records do not completely remove the drudgery involved in keeping time records. Indeed, many professionals refuse to keep time records, notwithstanding studies demonstrating the benefits of systematic time control records.

The present invention is directed to reducing the time and effort required by a professional in keeping time records, by eliminating the need for such professional to keep any paper records whatsoever. This invention is also directed to providing those professionals who do not keep systematic time records with a simple, inexpensive and almost effortless mechanism for so doing.

Devices directed to automating the task of keeping time records are known. One type of unit keeps track of a professional's time by means of a paper tape record. However, these devices are complex, costly, and inconvenient to operate as a result of the necessity to enter various client identification and case number codes onto the paper tape by punching appropriate keys on a keyboard.

Another type of time keeping and recorder unit, utilizing magnetic tape as the recording medium, appears to be somewhat less inconvenient to operate. However, this type of device is unnecessarily complicated and expensive, since it requires main elapsed time and telephone elapsed time circuitry, a dual channel magnetic recording head, and special transcribing equipment including a numeric display and associated amplifier.

SUMMARY OF THE INVENTION

The present invention is directed to providing an improved apparatus for recording time and other information, which is simpler, less expensive, easier to operate and more foolproof than known devices.

A time keeping and recording device, in accordance with the present invention, comprises a stop clock operable for measuring and displaying an elapsed time between starting and stopping the stop clock, audio recording means operable to record spoken messages, and circuit means including switch means operably connected to the stop clock and the recording means. The switch means is operable to reset and start the stop clock means, and is subsequently operable to stop the stop clock means so that the elapsed time may be read therefrom. An operation of the switch means to either reset and start the stop clock or to stop the stop clock simultaneously enables the recording means to record a spoken message. A user may start the stop clock and record a first spoken message comprising particulars of each activity being initiated, and may subsequently stop the stop clock, when the activity is concluded or suspended, and record a second spoken message comprising the elapsed time displayed by the stop clock, and further particulars if desired. A record of the user's activities over an extended period of time may thus be produced.

The invention is also directed to a time keeping and recording device comprising, in addition to the above components, timer means operably coupled to the recording means. The operation of the switch means to either start or stop the stop clock causes the timer means to enable the recorder means for a pre-specified time interval during which a spoken message may be recorded. A user may activate the stop clock and record a first spoken message comprising particulars of or activity being initiated, and the user may subsequently deactivate the stop clock and record a second spoken message comprising the elapsed time. A record of the user's activities over an extended period of time is thus produced.

To use the invention in its preferred embodiment, a professional or other user, when commencing a particular work activity, simply depresses a conveniently located switch, which initiates a timing cycle and starts the timer and recorder, and speaks into a microphone the particulars of the work activity such as, for example, the name of a person who has just called on the telephone, a particular file number, or other indicia identifying the matter to be worked on. The audio recorder is automatically deactivated after a preset time interval, such as 30 or 60 seconds, elapses, without further input from the operator. When the particular work activity is completed, or suspended as a result of a telephone call or other interruption, the operator simply depresses the same switch a second time, thereby terminating the timing cycle and reactivating the recorder for a further preset time interval. The elapsed time indicated by the stop clock may then be read by the user from the stop clock read-out, and this elapsed time information, together with any other pertinent information identifying the matter just completed or suspended, may be spoken into the microphone and thus recorded on magnetic tape. Again, the audio recorder is automatically deactivated after the preset time interval elapses. A further operation of the switch means initiates a second operating cycle as described above.

The end product of the device is a record on magnetic tape of a person's activities over an extended period of time, including the elapsed time spent on each activity, together with other information identifying each activity. The magnetic tape can be transcribed by a secretary or computer operator at convenient intervals, for direct billing purposes, or for input into a computerized bookkeeping and accounting system.

The present invention is accordingly a very simple, inexpensive and easy to operate device, which dispenses with the need for the expensive and complicated features and circuitry of known devices, while still performing the same function. Special transcribing equipment including a visual display is not required. Telephone interrupt circuitry is not required since a telephone interruption can be handled in the same manner as any other work activity. A keyboard is not required.

The professional or other operator of this device need not concern himself with difficult-to-remember client codes, matter codes or even file numbers. The operator can simply orally identify the client by name and briefly describe the nature of the work being performed on behalf of the client.

The device of present invention utilizes a single start/stop switch which is particularly easy and convenient to operate, unlike the known devices having multiple switches.

The present device is more foolproof than known devices, because an opportunity is provided for recording a spoken message identifying the matter at hand both at the start and the finish of a particular matter, thus minimizing the chances of inadvertently failing to properly identify a particular work activity.

The subject device is more versatile than various known devices, since it provides the opportunity to record various types of messages, including, for example, the real time information. The user also gets a better "feel" for the time it takes to perform various activities, since he himself reads the elapsed time off the display, and inputs it into the recorder, unlike known devices which do not provide a visual elapsed time display.

A busy lawyer in general practice, who typically spends only a few minutes on a given matter before such matter is suspended as a result of a telephone call or other interruption, should find that the device of the present invention is a particularly convenient means of producing time records.

The device of present invention is also particularly well adapted as a data input means for a computerized bookkeeping and accounting system. The magnetic tape containing the elapsed time recordals and other information can be conveniently transcribed by a computer operator directly into a computer programmed to generate debit notes and other accounting statements.

DETAILED DESCRIPTION OF THE EMBODIMENTS OF THE INVENTION

Figure 1:
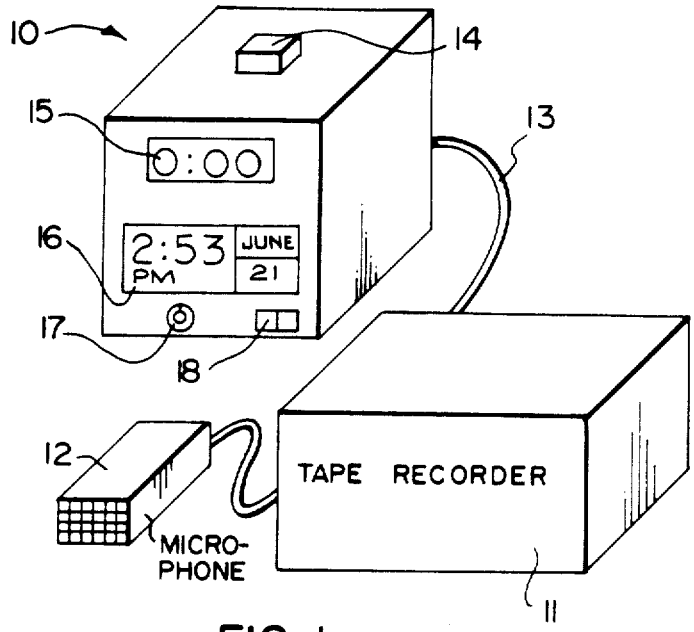
FIG. 1 is a perspective view of apparatus constructed in accordance with the preferred embodiment of the invention.

The preferred embodiment of a time keeping and recording device made in accordance with the invention is shown in FIG. 1. The device comprises a control unit generally designated as 10 which is electrically coupled to a conventional magnetic tape recorder 11, by means of control circuitry 13. Remote microphone 12 is coupled to recorder 11.

The control unit 10 includes a start-stop switch 14 located on the top of unit 10, stop clock display 15, preferably digital, optional real time display 16, timer interval setting dial 17 and power switch 18. The control unit 10 also includes timer means, power supply and associated circuitry (not shown).

Figure 2:
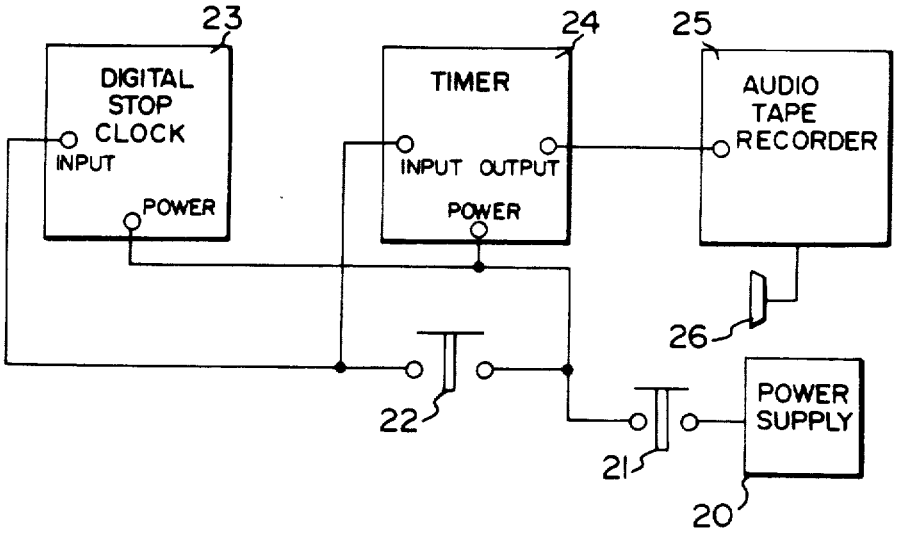
FIG. 2 is a block diagram illustrating an arrangement of the components and circuitry which may make up the preferred embodiment of the invention.

FIG. 2 is a block diagram illustrating a circuit for coupling together the components of the preferred embodiment. The circuit is powered by a conventional power supply 20 which, when activated by positioning power switch 21 in its closed circuit position, supplies power to start/stop switch 22, and to the power terminals of digital stop clock 23 and timer 24.

Start/stop switch 22, when positioned in its closed circuit position, connects the input terminals of both stop clock 23 and timer 24 to power supply 20. The output terminal of timer 24 is connected to audio tape recorder 25, having associated microphone 26. Switch 22 is preferably a push button switch, biased in an open circuit position, which closes a circuit in response to application of manual pressure, and which keeps the circuit closed until the pressure is released, at which time it re-opens the circuit.

Stop clock 23 is of conventional design, having a single reset/start/stop input terminal. A pulse received at such terminal while the clock is running stops the clock and freezes the elapsed time read-out; a pulse received at such terminal when the clock is stopped resets the read-out display to zero and starts the clock running.

Timer 24 is of conventional design which, when a voltage pulse is applied to its input terminal, produces a substantially steady output voltage signal for a pre-specified time interval of relatively short duration. The timer output signal in turn enables tape recorder 25 to record a spoken message received by microphone 26. By "enables to record" is meant that the recorder is activated in record mode.

Preferably, the time duration of the output signal of the timer 24 is variable, in the sense that it is may be preset by the user for 30 seconds, 60 seconds, or other convenient interval, depending upon the time it takes for the user to complete a typical spoken message. Audio tape recorder 25 is preferably a conventional cassette tape recorder to office dictaphone.

To operate, power switch 21 is placed in its "on" or closed circuit position, providing power to components 23 and 24. When initiating an activity, the user depresses switch 22 a first time, resulting in a voltage pulse being received at the input terminal of stop clock 23, which initiates a timing cycle (by resetting the display to zero and starting the clock running) and in a voltage pulse being received at input terminal of timer 24, which causes the timer 24 to produce an output signal at its output terminal for a pre-specified time duration, such signal in turn enabling the tape recorder 25 to record a spoken message. During this interval, the user may speak information into microphone 26, thereby recording same on magnetic tape. The recorder 25 stops recording after the signal at output terminal of timer 24 returns to zero, which takes place following expiry of the pre-specified time interval.

When the user wishes to suspend activity on a particular matter, he simply depresses switch 22 a second time. This operation results in a voltage pulse which terminates the timing cycle (by stopping the clock and freezing the display) and starts again the timer 24, which in turn produces an output signal which again drives the recorder 25 for the pre-specified time interval, during which the operator typically observes the elapsed time indicated on the stop clock display, and speaks this information, preferably together with other information identifying the matter being completed, into the microphone 26, with the result that such information is recorded on magnetic tape by recorder 25.

The stop clock 23 may alternatively be of the type having a reset switch separate from the start/stop switch, in the event that automatic resetting of the stop clock just prior to restarting same is not desired in all cases. If such a stop clock were to be used in the circuit, an additional reset switch would be required, and the operator would have to reset such switch just prior to beginning another work activity cycle.

Figure 3:
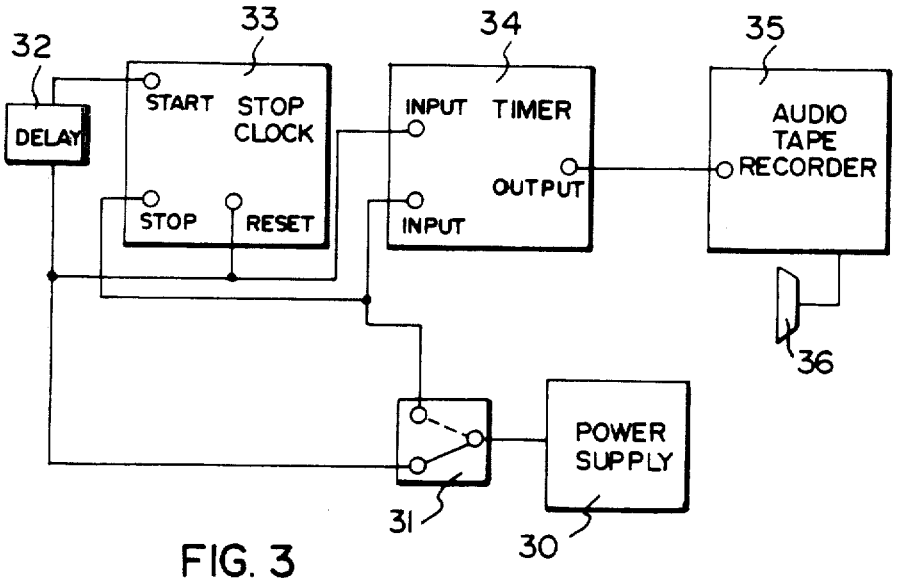
FIG. 3 is a block diagram illustrating another arrangement of components and circuitry which may make up the preferred embodiment of the invention.

FIG. 3 illustrates an alternative circuit for coupling together the components of the preferred embodiment. A power supply 30 supplies power to the input terminal of switch 31. When switch 31 is in a start position indicated by the solid line, power supply 30 is connected to reset terminal of stop clock 33 and via a delay 32 to the start terminal of stop clock 33, and to an input terminal of timer 34. When switch 31 is in a stop position indicated by the dotted line, power supply 30 is connected to the stop terminal of stop clock 33 and to a further input terminal of timer 34. The output terminal of timer 34 is in turn connected to recorder 35.

Stop clock 33, timer 34 and recorder 35 are all of conventional design. Stop clock 33 is of the type having separate start, stop and reset terminals, wherein a voltage pulse or leading edge of a voltage signal received at each of such terminals activates internal circuitry of the stop clock to start, stop or reset the clock, respectively. Timer 34 is of the type having two input terminals, wherein a positive voltage applied to either terminal causes a voltage to appear at the output terminal for a pre-specified time interval, such as 30 seconds. Recorder 35 is preferably a conventional cassette or mini cassette recorder, having microphone 36.

Switch 31 is preferably of the type which when depressed by a manual operation, remains in such depressed position until released by further application of manual pressure. The depressed position preferably corresponds to the start position indicated by the solid line in FIG. 3.

To operate, the user simply places switch 31 in the start position, which initiates a timing cycle and starts the timer, which in turn activates the recorder, for a short period of time, during which time the user may speak information identifying the matter to be handled into the microphone. When completing or suspending activity on a particular matter, the user places switch 31 in the stop position which terminates the timing cycle and starts again the timer. The timer again activates the recorder for a short period of time, allowing the user to record the elapsed time and any identifying information.

Figure 4:
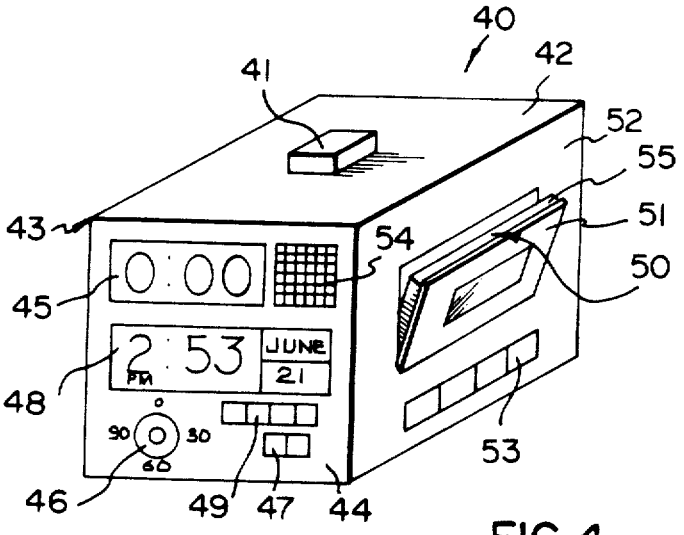
FIG. 4 is a perspective view of a unit constructed in accordance with the invention, such unit including built-in audio recording means.

The time keeping and recording device made in accordance with the invention may alternatively consist of a single unit having a built-in audio recording means, as illustrated in FIG. 4. Such device is designated generally as 40, and includes a switch 41 located on the top 42 of casing 43, or at any convenient-to-use location. The front panel 44 of single unit 40 includes stop clock read-out 45, preferably digital (although an analogue stop clock read-out may be provided), a timer interval setting dial 46, a power switch 47, and optionally a real time clock read-out 48 preferably including month and day indicators, and real time clock adjustment control 49. The device 40 includes built-in audio recording means generally designated as 50, including recording heads and other internal workings (not shown), and tape loading door 51 located on side panel 52 or other convenient area of casing 43 such as top 42. Control buttons 53 for recorder 50 may be provided on side panel 51. A built-in microphone 54 may be located on front panel 44, or a remote microphone may be provided. Information is recorded on mini-cassette tape 55.

Figure 5:
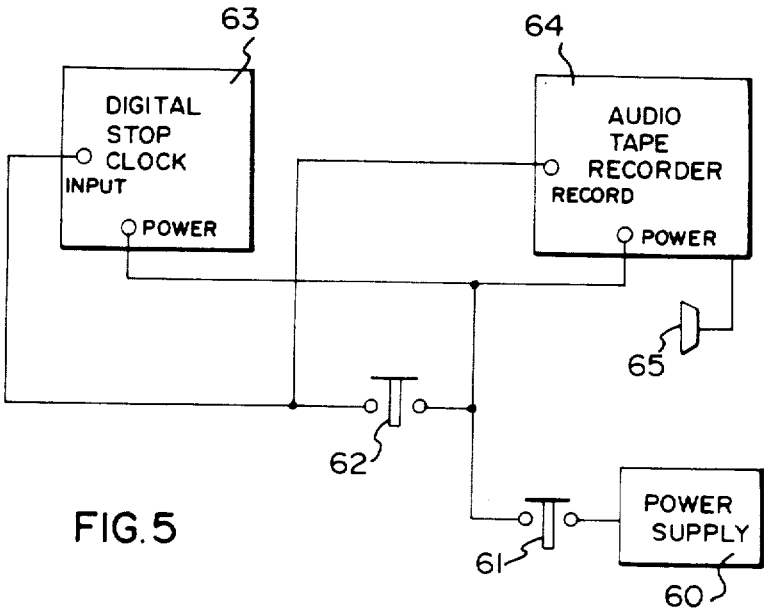
FIG. 5 is a block diagram illustrating components and circuitry which may make up an alternative embodiment of the invention.

Circuitry for an alternative embodiment of the invention, which does not make use of a timer, is illustrated in FIG. 5. A power supply 60, when power switch 61 is in a closed circuit position, supplies power to stop clock 63 and tape recorder 64. When start/stop switch 62 is placed a closed circuit position, stop clock 63 is reset and started, and simultaneously recorder 64 is enabled, but only for so long as switch 62 remains in the closed circuit position. Spoken information may be recorded on magnetic tape during the interval in which switch 62 remains in this position. When start/stop switch 62 is placed in an open circuit position, tape recorder 64 is stopped, but stop clock 63 continues to run until start/stop switch 62 is again placed in the closed circuit position, at which time the stop clock 63 is stopped, and recorder 64 again activated, providing an opportunity to record the elapsed time and other information, until such time as the switch is again placed in an open circuit position.

Stop clock 63 is of conventional design, like that of stop clock 23 described with reference to FIG. 2. Start/stop switch 62 is preferably of the type which is placed in a closed circuit position when manually depressed, and which reverts to an open circuit position once such pressure is released.

This alternative embodiment is less automated than the preferred embodiment, since more than two momentary operations of the start/stop switch are required. However, this embodiment provides for each recording period to be tailored exactly to the time required to speak each message.

Start/stop switch 62 may alternatively be of the type which, upon application of a momentary pressure remains in a depressed, closed-circuit position, until reapplication of manual pressure, at which time it reverts to a non-depressed, open-circuit position.

Figure 6:
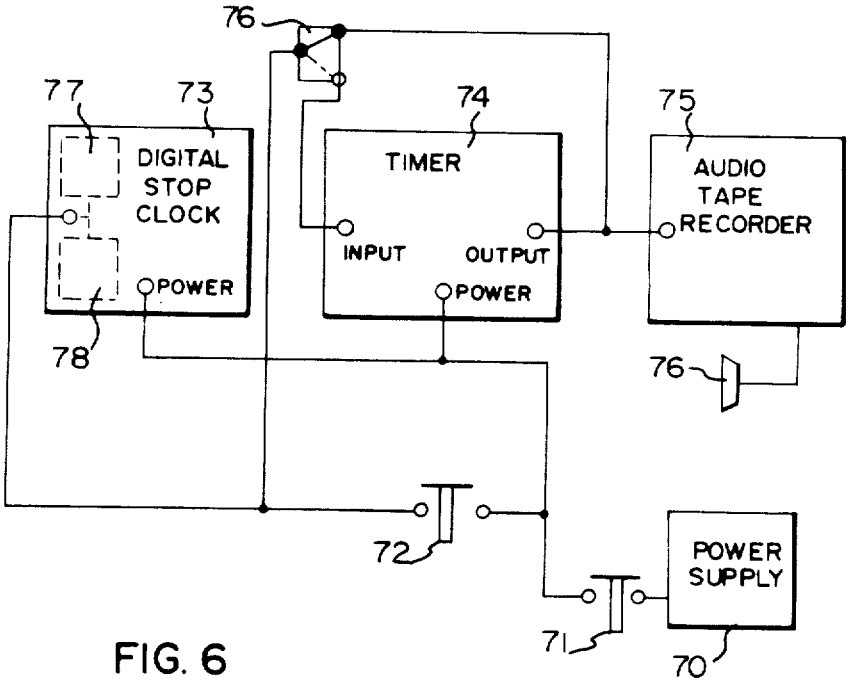
FIG. 6 is a block diagram illustrating components and circuitry which may make up a further alternative embodiment of the invention.

FIG. 6 is a block diagram illustrating a circuit for coupling the components of a further alternative embodiment of the invention which includes features of both of the preceding embodiments. Power supply 70, power switch 71, start/stop switch 72, stop clock 73, timer 74, recorder 75 and microphone 76 are preferably similar to components 20, 21, 22, 23, 24, 25 and 26 respectively, as described with reference to FIG. 2. Provided in addition to the above components is a timer over-ride switch 76, which, when in an "off" position indicated by the dotted line, connects input terminal of timer 74 with output terminal of switch 72, such that the circuit operates in a similar manner to that shown in FIG. 2 previously described. However, when switch 76 is in an "on" position indicated by the solid line, the input terminal of timer 74 is disconnected from the circuit, and recorder 75 is in turn directly connected to the output terminal of start/stop switch 72, such that the circuit operates like the circuit shown in FIG. 5.

Alternatively, stop clock 73 may include built-in audio alert means 77 which is capable of periodically emitting an audible signal (e.g. a beep or buzz) when the stop clock is activated, and every minute (or longer period) thereafter while the clock remains running, to periodically remind the user that the clock is still running, the period between such signals being capable of being varied to suit the preference of the user.

Stop clock 73 may also include internal display preservation means 78 which, when the stop clock is activated, allows for the previously displayed time to remain visible for five or ten seconds, to reduce the chances of the user failing to record the elapsed time associated with the previously handled matter.

While the invention has been described with particular reference to the embodiments shown in the drawings, it is to be understood that this description represents only the preferred and various alternative embodiments of the present invention. It will be apparent to those skilled in the art that many modifications of these embodiments may be made without departing from the scope of the present invention, which is defined in the appended claims.

I claim:

1. A time keeping and recording device, comprising:

(a) a stop clock operable for measuring and displaying an elapsed time between starting and stopping said stop clock;

(b) audio recording means operable to record spoken messages; and (c) circuit means including switch means operably connected to said stop clock and to said recording means;

(d) wherein said switch means is operable to reset and start said stop clock means, and is subsequently operable to stop said stop clock means so that said elapsed time may be read therefrom; and (e) wherein an operation of said switch means to either reset and start said stop clock or to stop said stop clock simultaneously enables said recording means to record a spoken message; whereby a user may reset and start said stop clock and record a first spoken message comprising particulars of an activity being initiated, and said user may subsequently stop said stop clock and record a second spoken message comprising the displayed elapsed time; whereby a record of said user's activities over an extended period of time may be produced by said audio recording means.

2. A time keeping and recording device as defined in claim 1, wherein said switch means comprises a manually actuatable control which when activated changes the state of said stop clock between off and on, and which simultaneously activates said recording means.

3. A time keeping and recording device as defined in claim 2, wherein the operation of said control to change the state of said stop clock from off to on also resets said stop clock to zero prior to the start of said stop clock.

4. A time keeping and recording device, as defined in claim 2, wherein said control comprises a manually depressable switch biased towards an off position, and wherein said recording means is enabled while said depressable switch is in an on position and not otherwise.

5. A time keeping and recording device as defined in claim 3, wherein said control comprises a manually depressable switch biased towards an off position, and wherein said recording means is enabled while said depressable switch is in an on position and not otherwise.

6. A time keeping and recording device as defined in claim 2 wherein said switch means further comprises a stop clock reset switch.

7. A time keeping and recording device, comprising:

(a) a stop clock operable for measuring and displaying an elapsed time;

(b) audio recording means operable to record spoken messages;

(c) timer means operably coupled to said recording means;

(d) circuit means including switch means operably connected to said stop clock and said timer means;

(e) wherein said switch means is operable to reset and start said stop clock means, and is subsequently operable to stop said stop clock means so that the elapsed time may be read therefrom; and (f) wherein operation of said switch means to either start or stop said stop clock causes said timer means to enable said audio recording means for a pre-specified time interval during which a spoken message may be recorded; whereby a user may reset and start said stop clock and record a first spoken message comprising particulars of an activity being initiated, and said user may subsequently stop said stop clock and record a second spoken message comprising the displayed elapsed time; whereby a record of said user's activities over an extended period of time may be produced by said audio recording means.

8. A time keeping and recording device as defined in claim 7, wherein said switch means comprises a manually actuatable control which when actuated changes the state of said stop clock between off and on and which simultaneously initiates operation of said timer means which enables said recording means for a pre-specified time interval.

9. A time keeping and recording device as defined in claim 8, wherein the operation of said control to change a state of said stop clock from off to on also resets said stop clock to zero prior to the start of said stop clock.

10. A time keeping and recording device as defined in claim 8, wherein said switch means further comprises a stop clock reset switch.

11. A time keeping and recording device as defined in claim 7, further comprising audio alert means operably coupled to said stop clock operable to emit an audible signal when said stop clock is started.

12. A time keeping and recording device as defined in claim 11, wherein said audio alert means is further operable to emit an audio signal each time a time period of pre-specified duration elapses.

13. A time keeping and recording device as defined in claim 7, further comprising display preservation means operably coupled to said stop clock operable to keep an existing display of elapsed time visible for a relatively short period of time after said stop clock has been started.

14. A time keeping and recording device as defined in claim 1, wherein said stop clock is a digital stop clock.

15. A time keeping and recording device as defined in claim 7, wherein said stop clock is a digital stop clock.

16. A time keeping and recording device as defined in claim 1, further comprising a real time clock.

17. A time keeping and recording device as defined in claim 7, further comprising a real time clock.

* * * * *

UNITED STATES PATENT AND TRADEMARK OFFICE

CERTIFICATE OF CORRECTION

PATENT NO. : 4,502,788

DATED : MARCH 5, 1985

INVENTOR(S) : COLIN B. LOWDEN

It is certified that error appears in the above-identified patent and that said Letters Patent is hereby corrected as shown below:

Column 4, line 36, delete "is" (second occurrence);

Column 4, line 41, delete "to" and substitute therefor --or--;

Column 6, line 12, after "placed", insert --in--.

Signed and Sealed this

*Twenty-second* Day of *October 1985*

[SEAL]

*Attest:*

DONALD J. QUIGG

*Attesting Officer*

*Commissioner of Patents and Trademarks—Designate*